US010152025B2

(12) United States Patent
Winkler et al.

(10) Patent No.: US 10,152,025 B2
(45) Date of Patent: Dec. 11, 2018

(54) HIGH QUALITY FACTOR RESONATOR FOR MECHANICAL WATCHES

(71) Applicant: ETA SA Manufacture Horlogere Suisse, Grenchen (CH)

(72) Inventors: Pascal Winkler, St-Blaise (CH); Gianni Di Domenico, Neuchatel (CH); Jean-Luc Helfer, Le Landeron (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/715,728

(22) Filed: Sep. 26, 2017

(65) Prior Publication Data

US 2018/0107164 A1 Apr. 19, 2018

(30) Foreign Application Priority Data

Oct. 18, 2016 (EP) ..... 16194286

(51) Int. Cl.

| | |
|---|---|
| ***G04B 17/04*** | (2006.01) |
| ***G04B 17/06*** | (2006.01) |
| ***G04C 3/08*** | (2006.01) |
| ***G04B 15/02*** | (2006.01) |
| ***G04B 15/00*** | (2006.01) |

(52) U.S. Cl.

CPC ..... *G04C 3/08* (2013.01); *G04B 15/00* (2013.01); *G04B 15/02* (2013.01); *G04B 17/04* (2013.01); *G04B 17/045* (2013.01); *G04B 17/06* (2013.01)

(58) Field of Classification Search

CPC ..... G04B 15/00; G04B 15/02; G04B 17/04; G04B 17/045; G04B 17/06

See application file for complete search history.

(56) References Cited

U.S. PATENT DOCUMENTS

| | | | |
|---|---|---|---|
| 2016/0179058 | A1 | 6/2016 | Born et al. |
| 2016/0223989 | A1 | 8/2016 | Winkler et al. |

FOREIGN PATENT DOCUMENTS

| | | | |
|---|---|---|---|
| CH | 710 160 | A2 | 3/2016 |
| EP | 3 035 127 | A1 | 6/2016 |
| EP | 3 054 356 | A1 | 8/2016 |
| EP | 3 054 358 | A1 | 8/2016 |

OTHER PUBLICATIONS

European Search Report dated Apr. 18, 2017 in European Application 16194286.7, filed on Oct. 18, 2016 (with English Translation of Categories of cited documents).

*Primary Examiner* — Vit W Miska

(74) *Attorney, Agent, or Firm* — Oblon, McClelland, Maier & Neustadt, L.L.P.

(57) ABSTRACT

Movement including an escapement mechanism and a resonator including an inertial element subjected to the action of a flexible gimbal and cooperating with an escape wheel set pivoting about a main axis, which includes driving means cooperating in a continuous transmission of motion with complementary means of the inertial element in every angular position of the latter, the flexible gimbal tending to return these complementary means towards the main axis, and including elastic return means about axes orthogonal to the main axis and restricting the mobility of the inertial element in two rotational degrees of freedom, about a fixed position of the centre of inertia of the inertial element with respect to a plate.

24 Claims, 4 Drawing Sheets

HIGH QUALITY FACTOR RESONATOR FOR MECHANICAL WATCHES

This application claims priority from European patent application No. 16194286.7 filed on Oct. 18, 2016, the entire disclosure of which is hereby incorporated herein by reference.

FIELD OF THE INVENTION

The invention concerns a timepiece movement for a mechanical watch, comprising, arranged on a main plate, a resonator mechanism and an escapement mechanism subjected to the torque of driving means comprised in said movement, said resonator mechanism comprising an inertial element arranged to oscillate with respect to said plate, said inertial element being subjected to the action of elastic return means directly or indirectly fixed to said plate, and said inertial element being arranged to cooperate with an escape wheel set comprised in said escapement mechanism and which pivots about a main axis.

The invention also concerns a mechanical watch including at least one such movement.

The invention concerns the field of resonator mechanisms forming the time bases of mechanical watches.

BACKGROUND OF THE INVENTION

Most current mechanical watches include a sprung-balance type resonator, which forms the time base of the watch, and an escapement mechanism, generally a Swiss lever escapement, which fulfils two main functions:

maintaining the back-and-forth motions of the resonator;

counting these back and forth motions.

The escapement must be robust, resist shocks, and be devised to avoid jamming the movement (overbanking).

A mechanical resonator combines at least one inertial element and one elastic return element. In the sprung-balance, the balance spring acts as the elastic return element for the inertial element formed by the balance.

The balance is guided in rotation by pivots which rotate in smooth ruby bearings. This produces friction, and therefore energy losses and disturbances in operation, which it is sought to remove. The losses are characterized by the quality factor, Q. It is sought to maximise the Q factor.

The Swiss lever escapement has low energy efficiency (around 30%). This low efficiency is due to the fact that the escapement motions are jerky, there are "drops" (runs to the banking to accommodate machining errors) and also because several components transmit their motion via inclined planes which rub against one another.

EP Patent Application 2908189 in the name of ETA Manufacture Horlogère Suisse discloses a mechanism for synchronizing two timepiece oscillators with a gear train, wherein a timepiece regulating mechanism comprises, mounted to move in at least a pivoting motion with respect to a plate, an escape wheel arranged to receive a drive torque via a gear train, and a first oscillator comprising a first rigid structure connected to the plate by first elastic return means. This regulating mechanism includes a second oscillator, which comprises a second rigid structure, which is connected to the first rigid structure by second elastic return means, and which includes guiding means arranged to cooperate with complementary guiding means comprised in the escape wheel, synchronizing the first oscillator and the second oscillator with the gear train.

EP Patent Application 3054358 in the name of ETA Manufacture Horlogère Suisse discloses a timepiece oscillator, which includes a structure and distinct primary resonators, which are temporally and geometrically shifted, each comprising a weight returned towards the structure by an elastic return means. This timepiece oscillator includes coupling means for the interaction between the primary resonators, including driving means for driving in motion a wheel set which includes driving and guiding means arranged to drive and guide a control means articulated to transmission means each articulated, at a distance from the control means, to a weight of a primary resonator, and the primary resonators and the wheel set are arranged such that the articulation axes of any two of the primary resonators and the articulation axis of the control means are never coplanar.

SUMMARY OF THE INVENTION

The present invention proposes to improve a timepiece movement combining a particular isochronous timepiece resonator mechanism, and an escapement mechanism, arranged in relation to each other so as to improve the quality factor of the resonator, particularly by removing the friction associated with conventional pivots, and to increase the efficiency of the escapement, by removing the usual jerky motions of the escapement.

To achieve these objects, the invention proposes a resonator wherein the elastic return element also forms the bearing member, in addition to mechanism architectures allowing continuous interactions, without jerky motions, between the resonator and escape wheel. To achieve this, it is necessary to allow the resonator the use of at least a second degree of freedom, wherein the second degree of freedom is out of phase with respect to the first. So that the resonator is not sensitive to gravity, or translational shocks, two degrees of freedom in rotation are selected, whose axes pass through the centre of mass of the inertial element.

Thus, the invention concerns a timepiece movement for a mechanical watch, comprising, arranged on a plate, a resonator mechanism and an escapement mechanism subjected to the torque of driving means comprised in said movement, said resonator mechanism comprising an inertial element arranged to oscillate with respect to said plate, said inertial element being subjected to the action of elastic return means directly or indirectly fixed to said plate, and said inertial element being arranged to cooperate with an escape wheel set comprised in said escapement mechanism and which pivots about a main axis, characterized in that said escape wheel set includes driving means arranged to cooperate in a continuous transmission of motion with complementary continuous driving means comprised in said inertial element in every angular position of the latter, and in that said elastic return means are arranged to tend to return said complementary continuous driving means towards said main axis, and in that said elastic return means include first elastic return means about a first axis and arranged to tend to return said complementary continuous driving means towards said main axis, and second elastic return means about a second axis and arranged to tend to return said complementary continuous driving means towards said main axis, said first axis and said second axis being perpendicular to each other and to said main axis, and in that said elastic return means form gimbal type guiding means and are arranged to prevent any movement of the centre of inertia of said inertial element in the three linear degrees of freedom and in one rotational degree of freedom, so as to allow said inertial element mobility in only two rotational degrees of freedom, about said first axis and said second axis and about a central point forming a fixed position of said centre of inertia with respect to said plate.

The invention also concerns a mechanical watch including at least one such movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
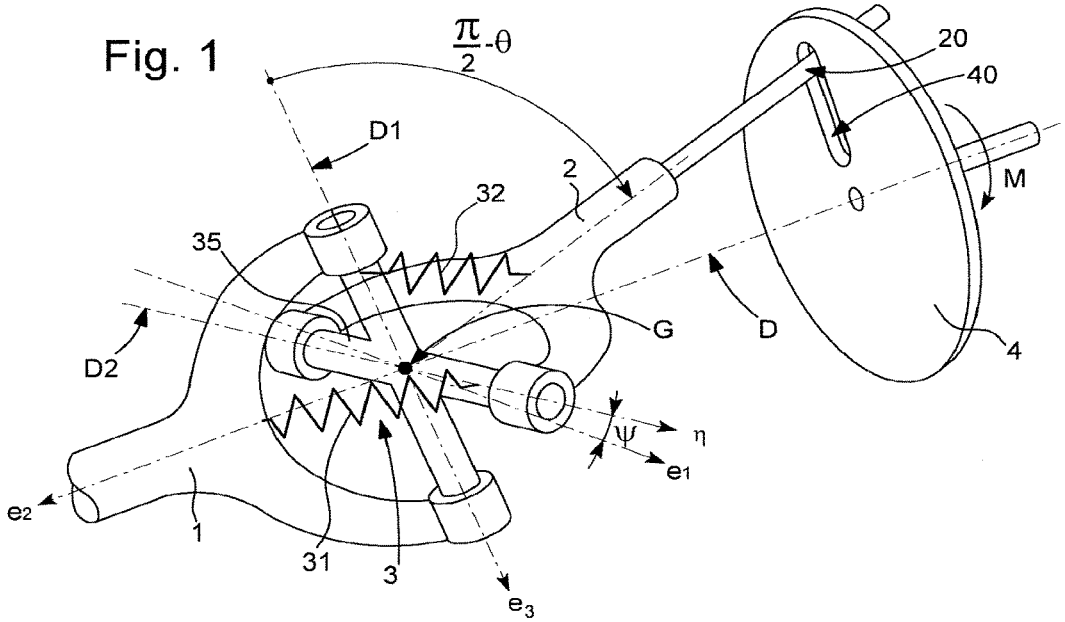
FIG. 1 represents a partial, schematic, perspective view of a movement according to the invention, including a resonator with a flexible gimbal, and a continuous maintaining mechanism, in a variation comprising guiding means distinct from the elastic return means.

The invention concerns a mechanical watch 1000, which is provided with a movement 500 that includes, mounted on a plate 1, a resonator 100 with a flexible gimbal and a continuous power maintaining mechanism 200, subjected to the torque of driving means 300, as seen in FIG. 16.

The flexible gimbal, seen in FIG. 1, and which will be described in detail below, has the function of locking an inertial element 2 of resonator 100 and plate 1 in three translations and in a first rotation, while leaving a second and third rotation flexible.

The rotational axes of the flexible rotations are perpendicular and pass through the centre of mass G of inertial element 2 of resonator 100.

The invention is illustrated here, in a non-limiting manner, with a single inertial element 2.

The Figures illustrating the mechanisms have a main axis D, a first axis D1, and a second axis D2.

Figure 2:
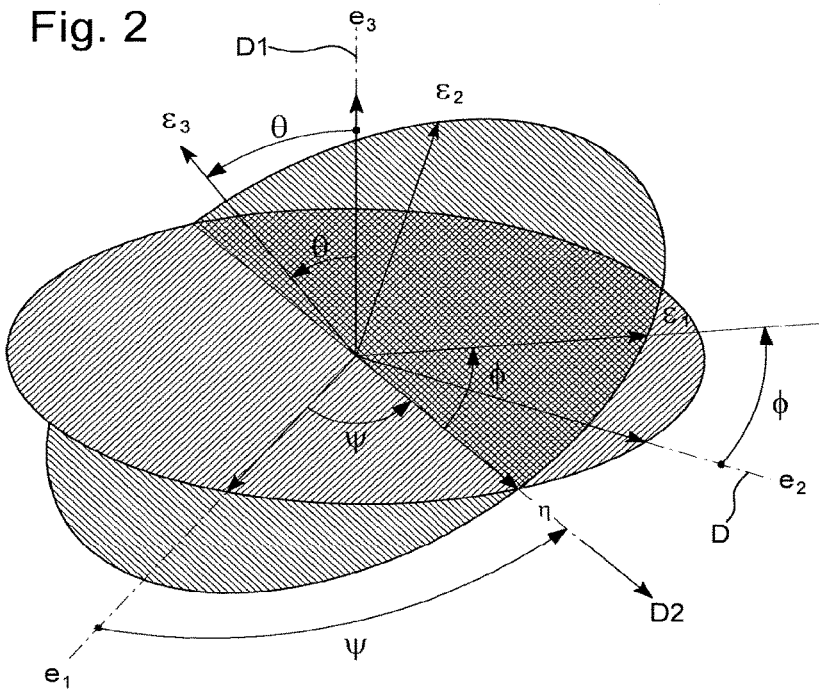
FIG. 2 represents a partial, schematic, perspective view of the Euler angles in a theoretical frame of reference used for the mathematical calculation of isochronism in the following description.
Figure 3:
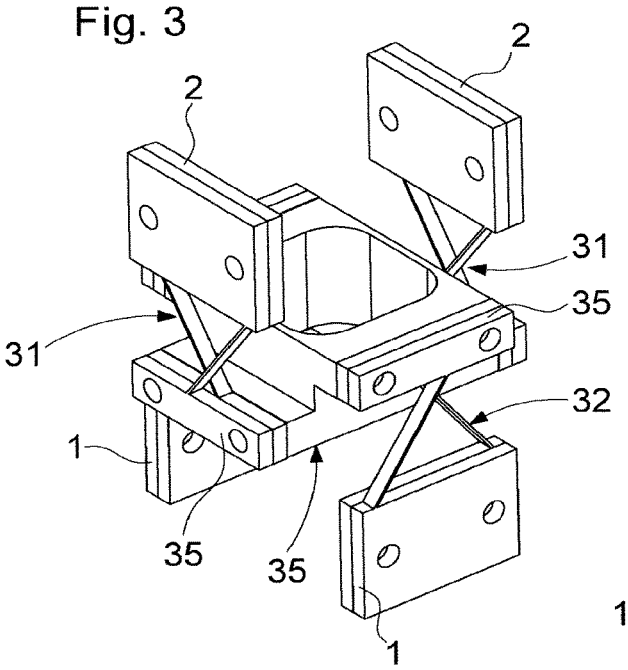
FIG. 3 represents a partial, schematic, perspective view of the rotating monolithic articulated structures or flexible guiding means, made here in a non-limiting manner in the form of elastic connections via crossed strips, in a resonator according to the invention, on the one hand between a plate and an intermediate crosspiece, and on the other hand, between this intermediate crosspiece and an inertial element.

FIG. 2 specifies the conventional definition of the Euler angles. The usual Euler directions correspond to physical axes in accordance with the rule:

D=e2;

D1=e3;

D2=n.

According to the invention, the flexible gimbal includes:

at least a first rotating flexible bearing, notably without a pivot, which defines a rotational axis D1=e3, set in a plate 1 on one side, and connected on the other side to an intermediate component 35, called a crosspiece, and at least a second rotating flexible bearing, notably without a pivot, defining a rotational axis n, also called the line of nodes, connected to crosspiece 35 on one side, and connected to inertial element 2 of resonator 100 on the other.

According to the invention, the flexibility of each of these rotating flexible guiding means gives rise to a return torque proportional to the angle of rotation for the rotation concerned.

According to the invention, inertial element 2 has an inertia matrix whose components in directions e2 and e3 are substantially identical.

These latter two features make it possible to obtain isochronism of the system, regardless of the trajectory of inertial element 2.

Indeed, these features simplify the general Lagrangian, often designated by a cursive capital letter L, and expressed here by the expression "Lag", which is equal to the difference between the kinetic energy Ec=T (total, which involves speed) and the potential energy Ep=V (total, which involves position) of the system:

$$\mathrm{Lag}(\theta,\phi,\psi)=T(\theta,\phi,\psi)-V(\theta,\phi,\psi)$$

with:

$$T=\tfrac{1}{2}I_1(d\theta/dt\cdot\cos\phi+d\psi/dt\cdot\sin\theta\cdot\sin\phi)^2+\tfrac{1}{2}I_2(-d\theta/dt\cdot\sin\phi+d\psi/dt\cdot\sin\theta\cdot\cos\phi)^2+\tfrac{1}{2}I_3(d\phi/dt+d\psi/dt\cdot\cos\theta)^2$$

In the present invention, locking one of the rotations means that, in the illustrated variant, $\phi=0$, permanently, which simplifies the expression of the Lagrangian:

$$\mathrm{Lag}(\theta,\phi,\psi)=\tfrac{1}{2}I_1(d\theta/dt)^2+\tfrac{1}{2}I_2(d\psi/dt)^2\cdot\sin^2\theta+\tfrac{1}{2}I_3(d\psi/dt)^2\cdot\cos^2\theta+\tfrac{1}{2}C_\theta\cdot\theta^2+\tfrac{1}{2}C_\psi\cdot\psi^2$$

Si I2=I3=I23, one then obtains:

$$\mathrm{Lag}(\theta,\phi,\psi)=\tfrac{1}{2}I_1(d\theta/dt)^2+\tfrac{1}{2}I_{23}(d\psi/dt)^2+\tfrac{1}{2}C_\theta\cdot\theta^2+\tfrac{1}{2}C_\psi\cdot\psi^2$$

which corresponds to the Lagrangian of two isochronous oscillators according to θ and ψ.

The invention thus makes it possible to achieve the best possible isochronism.

It is also possible, in a particular embodiment, to make the frequency identical between oscillations of angles θ and ψ.

In particular, the period of oscillation in the two rotations is substantially identical. That is to say:

$$2*\pi*\sqrt{\left\{\frac{\{I_1\}}{\{C_{\{\theta\}}\}}\right\}} = 2*\pi*\sqrt{\{\{I_{23}\}/\{C_{\{\psi\}}\}\}}$$

FIG. 1 shows the cooperation of a finger 21, comprised in inertial element 2, with a slot 41 comprised in an escape wheel set 4, typically the equivalent of an escape wheel, comprised in continuous power maintaining mechanism 200. It is understood that, in the absence of such an escape wheel set 4, the position of equilibrium of finger 21 in the free state would be on main axis D. The above equation ensures, in the steady state, a circular trajectory of this finger 21 with respect to the pivot axis of escape wheel set 4.

By applying this flexible gimbal principle, the invention more particularly concerns a timepiece movement 500 for a mechanical watch 1000.

This movement 500 includes, arranged on a plate 1, a resonator mechanism 100 and an escapement mechanism 200 subjected to the torque of driving means 300 comprised in movement 500.

Resonator mechanism 100 includes at least one inertial element 2, which is arranged to oscillate with respect to plate 1. This inertial element 2 is subjected to the action of elastic return means 3, 31, 32, which are directly or indirectly fixed to plate 1. And this inertial element 2 is arranged to cooperate with an escape wheel set 4 comprised in escapement mechanism 200 and which pivots about a main axis D.

According to the invention, escape wheel set 4 includes driving means 40, which are arranged to cooperate in a continuous transmission of motion with complementary continuous driving means 20 comprised in inertial element 2 in every angular position of the latter.

And elastic return means 3, 31, 32 are arranged to tend to return the complementary continuous driving means 20 towards main axis D.

these elastic return means 3, 31, 32 include first elastic return means 31 about a first axis D1 and which are arranged to tend to return complementary continuous driving means 20 towards main axis D, and second elastic return means 32 about a second axis D2 and which are arranged to tend to return complementary continuous driving means 20 towards main axis D.

First axis D1 and second axis D2 are perpendicular to each other and perpendicular to main axis D.

And elastic return means 3, 31, 32 form gimbal type guiding means and are arranged to prohibit movement of the centre of inertia G of inertial element 2 in the three linear degrees of freedom and in one rotational degree of freedom, so as to allow inertial element 2 mobility in only two rotational degrees of freedom, about first axis D1 and second axis D2, and about a central point forming a fixed position of centre of inertia G with respect to plate 1.

In particular, main axis D, first axis D1 and second axis D2 are concurrent.

In an advantageous embodiment illustrated by the Figures, first elastic return means 31 and second elastic return means 32 are arranged in series, first elastic return means 31 being arranged between plate 1 and an intermediate crosspiece 35, and second elastic return means 32 being arranged between intermediate crosspiece 35 and inertial element 2, or vice versa.

In a particular embodiment, first elastic return means 31, on the one hand, and second elastic return means 32 on the other, are arranged to apply a return torque proportional to the angle of rotation imparted to them, on at least a portion of their rotational travel. More particularly, this proportionality applies for their entire angular travel. If necessary, angular limiting means are arranged to limit the flexibility of these elastic return means to the range in which the return torque that they apply is proportional to the angle of rotation that is imparted to them.

To obtain optimum isochronism of the resonator, inertial element 2 has, with respect to the frame of reference formed by main axis D, first axis D1 and second axis D2, a diagonal inertia matrix, whose terms are equal along at least two of main axis D, first axis D1 and second axis D2.

More particularly, when, as seen in FIGS. 1, 3, 6 and 12, the first elastic return means 31 and second elastic return means 32 are arranged in series, first elastic return means 31 being arranged between plate 1 and an intermediate crosspiece 35, and second elastic return means 32 being arranged between intermediate crosspiece 35 and inertial element 2, inertial element 2 has, with respect to the frame of reference formed by main axis D, first axis D1 and second axis D2, a diagonal matrix of inertia, whose terms are equal along main axis D and first axis D1.

Figure 6:
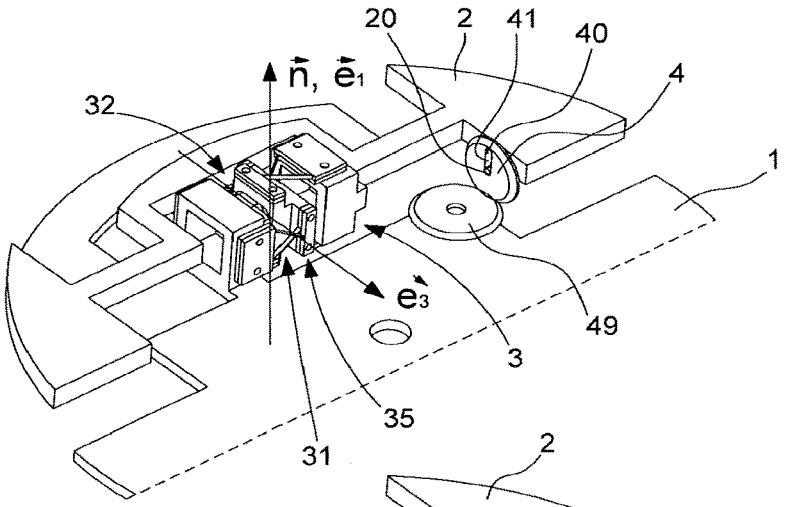
FIG. 6 represents a schematic, perspective view of a movement according to the invention, in a variant comprising guiding means which are combined with elastic return means, and including a resonator with a flexible gimbal positioned on a plate represented in FIG. 7, with rotating flexible guiding means, notably with elastic connections as in FIG. 3 and illustrated in FIG. 8, and an inertial element illustrated in FIG. 9 including a finger cooperating with a slot of a contrate wheel, forming the escape wheel set, and cooperating, as seen in FIG. 10, via an oblique toothing, with the end of a gear train subjected to the torque of a barrel, not represented in the Figures.
Figure 9:
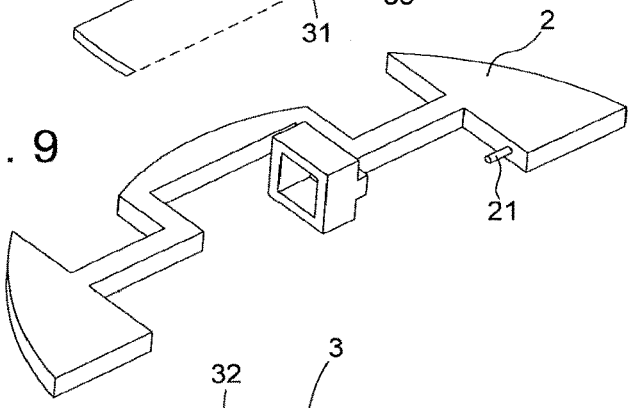
Figure 8:
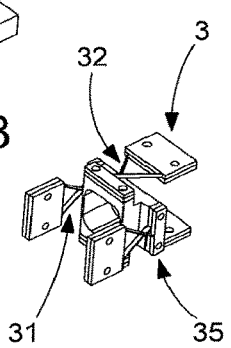
Figure 10:
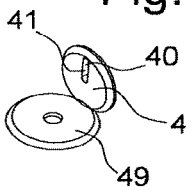
Figure 7:
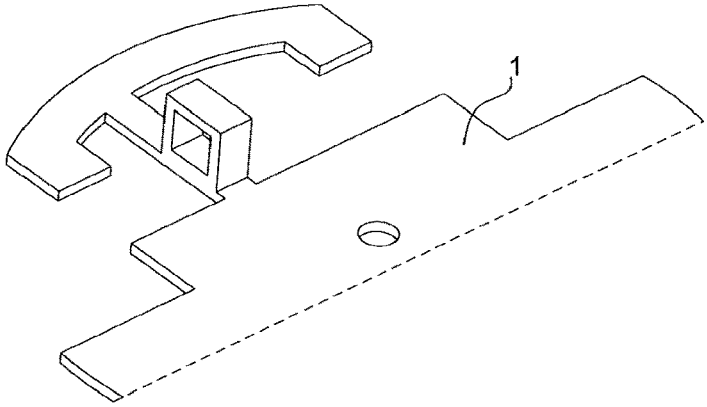

In the variants of FIGS. 1 and 6, driving means 40 include a substantially radial slot 41 relative to main axis D, and which cooperates with a finger 21 comprised in complementary continuous driving means 20. In that case the continuous maintaining mechanism includes this finger 21 integral with inertial element 2, which is driven in rotation by wheel 4 with slot 41, which cooperates via an oblique toothing with another wheel 49 at the end of a gear train, and is thus subjected to the torque of driving means 300, notably of at least one barrel. Wheel 4 rotates here about an axis perpendicular to the plane defined by the axes of rotation of the two flexible rotations.

Advantageously, and as illustrated by the Figures, first elastic return means 31 and/or second elastic return means 32 are formed by rotating flexible guiding means devoid of pivots.

In a particular implementation of the invention, first elastic return means 31 and second elastic return means 32 form together a monolithic component.

In a particular embodiment of the invention, illustrated by the Figures, first elastic return means 31 and/or second elastic return means 32 include rotating flexible guiding means with two strips, which are either crossed on the same level, or strips located in two close parallel levels and whose projections onto a plane parallel to these levels, intersect.

Figure 4:
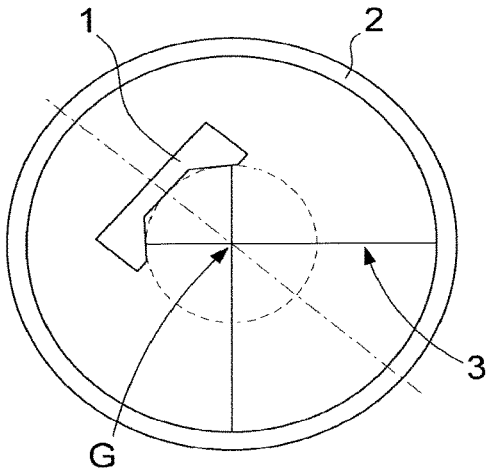
FIG. 4 represents a schematic, plan view of a rotating flexible bearing, notably with elastic connections between two solids via strips that intersect in projection, with a particular arrangement of the angle and position of the intersection axis of the strips, ensuring excellent isochronism.

In this variant of a flexible bearing with two strips, the point of real or projected intersection of the two strips is, as seen in FIG. 4, advantageously situated at a point located between 0.12 and 0.14 times their length, and these strips form between them an angle comprised between 60 and 80 degrees.

In another variant, first elastic return means 31 and/or second elastic return means 32 include rotating flexible guiding means with RCC pivots arranged head-to-tail.

In yet another variant, first elastic return means 31 and/or second elastic return means 32 are doubled, or more generally multiplied, to increase the stiffness of the flexible gimbal in the degrees of freedom that must be related.

In a particular variant, first elastic return means 31 and/or second elastic return means 32 include rotating flexible guiding means with flexible strips, where the strips are made of elinvar.

In another particular variant, first elastic return means 31 and/or second elastic return means 32 include rotating flexible guiding means with flexible strips, wherein said strips are made of oxidized silicon to compensate for the effects of temperature variations.

Figure 5:
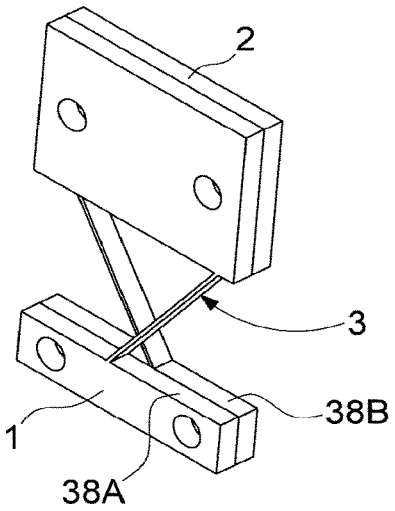
FIG. 5 represents a schematic, perspective view of an embodiment of a bearing with strips crossed in projection, by the juxtaposition of two identical plates mounted back-to-back.

In another variant, as seen in FIG. 5, first elastic return means 31 and/or second elastic return means 32 include rotating flexible guiding means with two strips, which are strips situated in two close parallel levels and whose projections onto a plane parallel to said levels intersect, each said strip belonging to a monolithic module 38 including the strip and its means of attachment, and the flexible bearing with two strips including two such modules 38 assembled back-to-back.

In a particular variant, first elastic return means 31 and/or second elastic return means 32 are calculated such that a first oscillation period T1, a function of a first inertia I1 and of a first elastic constant k1 of the bearing in a first rotation about first axis D1, is equal to a second oscillation period T2, a function of a second inertia I2 and of a second elastic constant k2 of the bearing in a second rotation about second axis D2.

More particularly, first elastic return means 31 and second elastic return means 32 have identical features.

In a particular variant, as seen in FIG. 6, the plane defined by first axis D1 and second axis D2, in equilibrium, is perpendicular to the plane of plate 1 and main axis D2 is parallel to the plane of the plate D.

Figure 11:
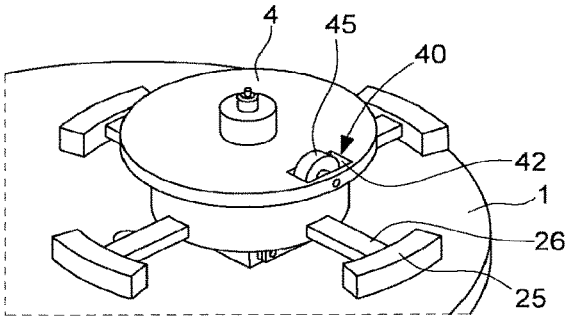
FIGS. 11 and 12 illustrate, in a schematic and perspective view, a movement according to another variant of the invention, also including guiding means combined with elastic return means, respectively assembled in FIG. 11 and in an exploded view in FIG. 12, where a plate carries, by means of rotating flexible guiding means, notably with elastic connections according to FIG. 3, a substantially cross-shaped inertial element comprising an upper annular track, on which rolls a roller, housed inside a notch of an escape wheel set, which is pivoted inside a housing of the plate and in a bar (not represented), wherein this roller exerts an off-centre thrust force on the inertial element, subjecting the latter to a precession rotational motion.
Figure 13:
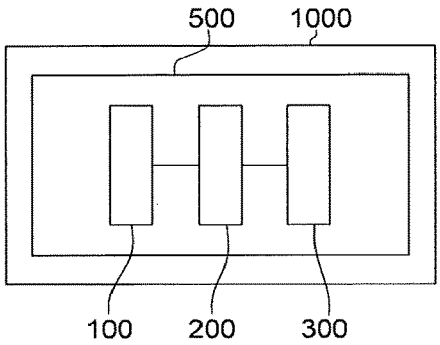
FIG. 13 is a block diagram representing a watch including such a movement.
Figure 12:
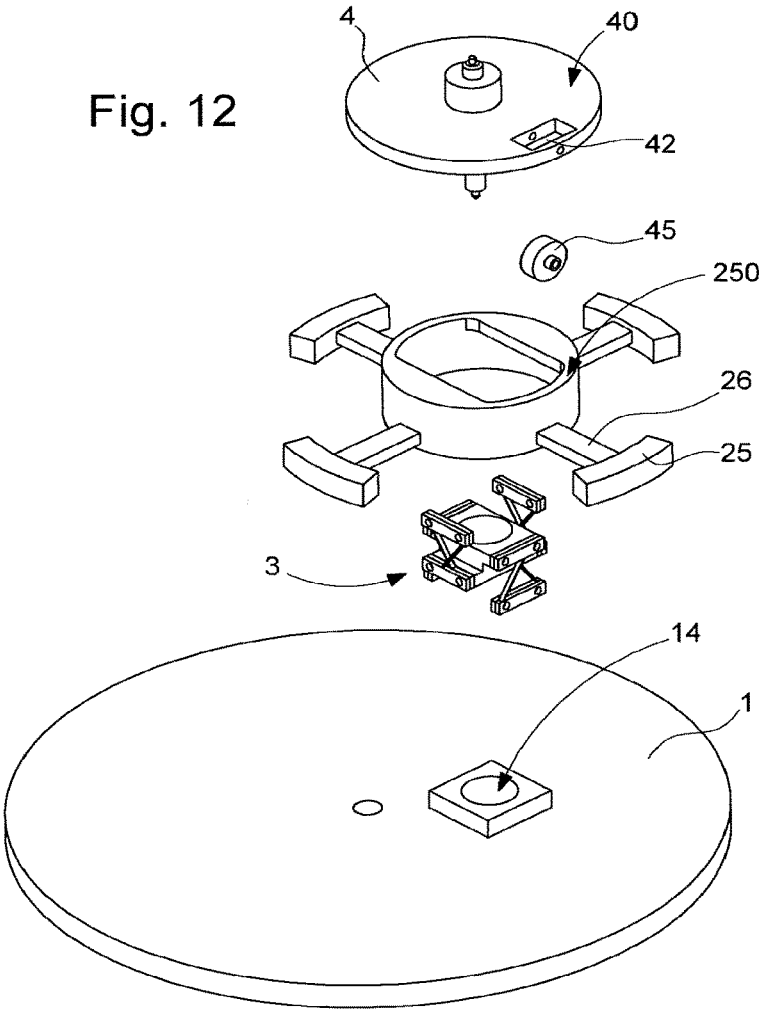

In another variant, as seen in FIG. 11, the plane defined by first axis D1 and second axis D2, in equilibrium, is parallel to the plane of plate 1, and main axis D is perpendicular to the plane of the plate D.

In a variant illustrated in FIG. 11, driving means 40 include a hole 42 arranged for guiding a roller 45. This roller 45 is arranged to roll on an annular track 250 comprised in inertial element 2, said track 250 forms the complementary continuous driving means 20. Roller 45 thus imparts an off-centre force to the inertial element, and a torque, which, combined with flexible gimbal 3, imparts to inertial element 2 a precessional motion, like a coin or a plate spun on a plane surface due to a torque, or of a gyroscope or spinning top. The continuous maintaining mechanism is then formed of a ring carrying annular track 250 and integral with inertial element 2, driven in a precessional motion by wheel 4 with roller 45, subjected to the torque of driving means 300, notably of at least one barrel, wherein wheel 4 rotates about an axis perpendicular to the plane defined by the axes of rotation of the two flexible rotations.

It will be noted in this regard that a gyroscope with three rings whose intermediate ring, similar to the crosspiece described above, is connected by a balance spring to each of the inner and outer rings, may form a resonator according to the invention.

In a particular embodiment, first elastic return means 31 and/or second elastic return means 32 include rotating flexible guiding means with crossed strips, and are protected from breakage after a shock by mechanical stops.

In a particular embodiment, inertial element 2 includes inertia blocks for adjusting the inertia and unbalance.

The invention also concerns a timepiece, particularly a mechanical watch 1000, including one such movement 500.

In short, the present invention offers particular advantages:

obtaining isochronism of the resonator, whatever the trajectory of the inertial element;

removing the friction of the resonator pivots, by replacing them with rotating flexible guiding means, making it possible to increase the quality factor;

removing the jerky motions of the escapement, as a result of continuous maintenance, making it possible to increase the efficiency of the escapement.

What is claimed is:

1. A timepiece movement for a mechanical watch, comprising, arranged on a plate, a resonator mechanism and an escapement mechanism subjected to the torque of driving means comprised in said movement, said resonator mechanism including an inertial element arranged to oscillate with respect to said plate, said inertial element being subjected to the action of elastic return means directly or indirectly fixed to said plate, and said inertial element being arranged to cooperate with an escape wheel set comprised in said escapement mechanism and which pivots about a main axis, wherein said escape wheel set includes driving means arranged to cooperate in a continuous transmission of motion with complementary continuous driving means comprised in said inertial element in every angular position of the latter, and in that said elastic return means are arranged to tend to return said complementary continuous driving means towards said main axis, and in that said elastic return means include first elastic return means about a first axis and arranged to tend to return said complementary continuous driving means towards said main axis, and second elastic return means about a second axis and arranged to tend to return said complementary continuous driving means towards said main axis, said first axis and said second axis being perpendicular to each other and to said main axis, and in that said elastic return means form gimbal type guiding means and are arranged to prohibit the movement of the centre of inertia of said inertial element in the three linear degrees of freedom and in one rotational degree of freedom, so as to allow said inertial element mobility in only two rotational degrees of freedom, about said first axis and said second axis and about a central point forming a fixed position of said centre of inertia with respect to said plate.

2. A movement according to claim 1, wherein said main axis, said first axis and said second axis are concurrent.

3. The movement according to claim 1, wherein said first elastic return means and said second elastic return means are arranged in series, said first elastic return means being arranged between said plate and an intermediate crosspiece, and said second elastic return means being arranged between said intermediate crosspiece and said inertial element, or vice versa.

4. The movement according to claim 1, wherein said first elastic return means, on the one hand, and said second elastic return means on the other, are arranged to apply a return torque proportional to the angle of rotation imparted thereto.

5. The movement according to claim 1, wherein said inertial element has, with respect to the frame of reference formed by said main axis, said first axis and said second axis, a diagonal inertia matrix, whose terms are equal along at least two of said main axis, said first axis and said second axis.

6. The movement according to claim 2, wherein said inertial element has, with respect to the frame of reference formed by said main axis, said first axis and said second axis, a diagonal inertia matrix, whose terms are equal along at least two of said main axis, said first axis and said second axis, and wherein said inertial element has, with respect to the frame of reference formed by said main axis, said first axis and said second axis, a diagonal inertia matrix, whose terms are equal along said main axis and said first axis.

7. The movement according to claim 1, wherein said driving means include a substantially radial slot relative to said main axis and which cooperates with a finger comprised in said complementary continuous driving means.

8. The movement according to claim 1, wherein said first elastic return means and/or said second elastic return means are formed by rotating flexible guiding means devoid of pivots.

9. The movement according to claim 1, wherein said first elastic return means and/or said second elastic return means together form a monolithic component.

10. The movement according to claim 1, wherein said first elastic return means and/or said second elastic return means include rotating flexible guiding means with two strips, which are either crossed on the same level, or strips located in two close parallel levels and whose projections onto a plane parallel to said levels intersect.

11. The movement according to claim 1, wherein, in a said rotating flexible bearing with two strips, the real or projected point of intersection of the two strips is located at a point situated between 0.12 and 0.14 times the length of said strips, and said two strips form between them an angle comprised between 60 and 80 degrees.

12. The movement according to claim 1, wherein said first elastic return means and/or said second elastic return means include rotating flexible guiding means of the RCC pivot type arranged head-to-tail.

13. The movement according to claim 1, wherein said first elastic return means and/or said second elastic return means are double to increase the stiffness of the flexible gimbal in the degrees of freedom that must be related.

14. The movement according to claim 1, wherein said first elastic return means and/or said second elastic return means include rotating flexible guiding means with flexible strips, wherein said strips are made of elinvar.

15. The movement according to claim 1, wherein said first elastic return means and/or said second elastic return means include rotating flexible guiding means with flexible strips, wherein said strips are made of oxidized silicon to compensate for the effects of temperature variations.

16. The movement according to claim 1, wherein said first elastic return means and/or said second elastic return means include rotating flexible guiding means with two strips, which are strips located in two close parallel levels and whose projections onto a plane parallel to said levels intersect, each said strip belonging to a monolithic module comprising said strip and the means of attachment thereof, and said flexible bearing with two strips comprising two said modules assembled back-to-back.

17. The movement according to claim 1, wherein a first oscillation period, a function of a first inertia and of a first elastic constant of the bearing in a first rotation about said first axis, is equal to a second first oscillation period, a function of a second inertia and of a second elastic constant of the bearing in a second rotation about said second axis.

18. The movement according to claim 1, wherein said first elastic return means and/or said second elastic return means have identical features.

19. The movement according to claim 1, wherein the plane defined by said first axis and said second axis, in equilibrium, is perpendicular to the plane of said plate, and in that said main axis is parallel to the plane of said plate.

20. The movement according to claim 1, wherein the plane defined by said first axis and said second axis, in equilibrium, is parallel to the plane of said plate, and in that said main axis is perpendicular to the plane of said plate.

21. The movement according to claim 1, wherein said driving means include a hole arranged to guide a roller arranged to roll on an annular track comprised in said inertial element, which forms said complementary continuous driving means.

22. The movement according to claim 1, wherein said first elastic return means and/or said second elastic return means include rotating flexible guiding means with crossed strips and are protected from breakage following a shock by mechanical stops.

23. The movement according to claim 1, wherein said inertial element includes inertia blocks for adjusting inertia and unbalance.

24. A mechanical watch including a movement according to claim 1.

* * * * *